United States Patent [19]

Dills

[11] 4,434,344

[45] Feb. 28, 1984

[54] SELF-STORING MEAL RACK FOR A MICROWAVE OVEN

[75] Inventor: Raymond L. Dills, Louisville, Ky.

[73] Assignee: General Electric Company, Louisville, Ky.

[21] Appl. No.: 407,387

[22] Filed: Aug. 12, 1982

[51] Int. Cl.[3] ..... H05B 6/80; F24C 15/16

[52] U.S. Cl. ..... 219/10.55 E; 219/10.55 R; 219/392; 99/449; 99/450; 126/337 A; 211/150; 312/236; 312/269

[58] Field of Search ..... 219/10.55 R, 10.55 E, 219/10.55 F, 392; 99/448, 449, 450, 451; 126/337 R, 334, 337 A, 333; 108/145; 312/266, 267, 269, 27, 236, 248; 211/153, 150; 248/239, 243

[56] References Cited

U.S. PATENT DOCUMENTS

| | | | |
|---|---|---|---|
| 999,633 | 8/1911 | Cramer | 126/337 A |
| 2,667,396 | 1/1954 | Liggett | 312/248 |
| 2,904,380 | 9/1959 | Mark | 312/27 |
| 3,936,627 | 2/1976 | Fitzmayer | 219/10.55 F |
| 3,949,184 | 4/1976 | Freedman | 219/10.55 E |
| 4,329,557 | 5/1982 | Staats | 219/10.55 E X |

FOREIGN PATENT DOCUMENTS

| | | | |
|---|---|---|---|
| 52-70454 | 6/1977 | Japan | 219/10.55 E |

*Primary Examiner*—B. A. Reynolds
*Assistant Examiner*—Philip H. Leung
*Attorney, Agent, or Firm*—Frank P. Giacalone; Radford M. Reams

[57] ABSTRACT

A self-storing meal rack for a microwave oven having an indexing mechanism for holding the rack in a lower or cooking or an upper storage position. The rack is rotated about a pivot between the cooking and storage position. Clearance is provided in the upper storage position so that the rack does not interfere with the polarization of excitation of the oven even though it is stored adjacent the upper wall of the oven cavity. In the lower or cooking position, the rack is spaced from the lower wall of the oven cavity a distance sufficient to permit food to be placed on the bottom wall of the oven cavity.

3 Claims, 5 Drawing Figures

SELF-STORING MEAL RACK FOR A MICROWAVE OVEN

BACKGROUND OF THE INVENTION

This invention relates to microwave ovens and more particularly to a microwave oven wherein removable meal supporting racks are provided. It is common in microwave ovens to provide a rack system wherein food to be cooked may be arranged at different levels in the oven cavity. Generally, these systems incorporate removable racks that can be selectively placed in the cavity at different levels. In many instances, when not in use the rack must be removed from the oven and stored. This is especially true when the food to be cooked is of a size or shape that would cause the rack to interfere with the placement of the food and necessitate the removal of the rack. Removing and storing the rack when not in use is an inconvenience and one that can lead to the rack being lost or damaged.

By this invention, there is provided a rack arrangement for microwave oven which does not have to be removed from the oven for storing when not in use, and can be removed for cleaning when necessary.

SUMMARY OF THE INVENTION

The present invention relates to an adjustable meal rack for microwave oven and more particularly to a self-storing rack. The rack is movable between a cooking position which allows items to be cooked to be arranged at two levels simultaneously within the oven and storage position when not in use. The rack in the present instance is pivotally mounted to support arms which are pivotally mounted to the side walls of the oven. The rack is arranged so that it can be swung through the door access opening while moving between its cooking and storage positions. A locking arrangement is provided for retaining the rack in either of its two positions. When the rack is located in the storage position, clearance is provided so that the rack does not interfere with the polarization of excitation of the oven.

DESCRIPTION OF THE PREFERRED EMBODIMENT

Figure 1:
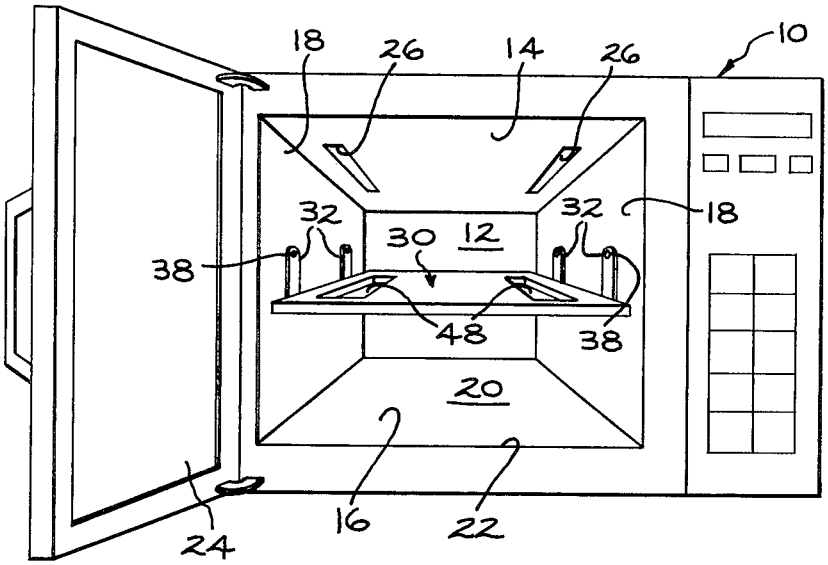
FIG. 1 is a front perspective of a microwave oven incorporating the rack system of the present invention.

Referring to the drawings, the microwave oven 10 incorporating the present invention comprises a rear wall 12, parallel top and bottom walls 14 and 16, respectively, which together with side walls 18 form the oven cavity generally designated 20 and an access opening 22 over which is arranged a hingedly mounted door 24.

For coupling microwave energy into the cavity 20, the top wall 14 of the cavity 20 includes a plurality of waveguide slots or apertures 26 which couple microwave energy from a waveguide system (not shown) supplied by a magnetron (not shown) into cavity 20. It will be appreciated that the microwave feed system does not form any part of the present invention.

Figure 2:
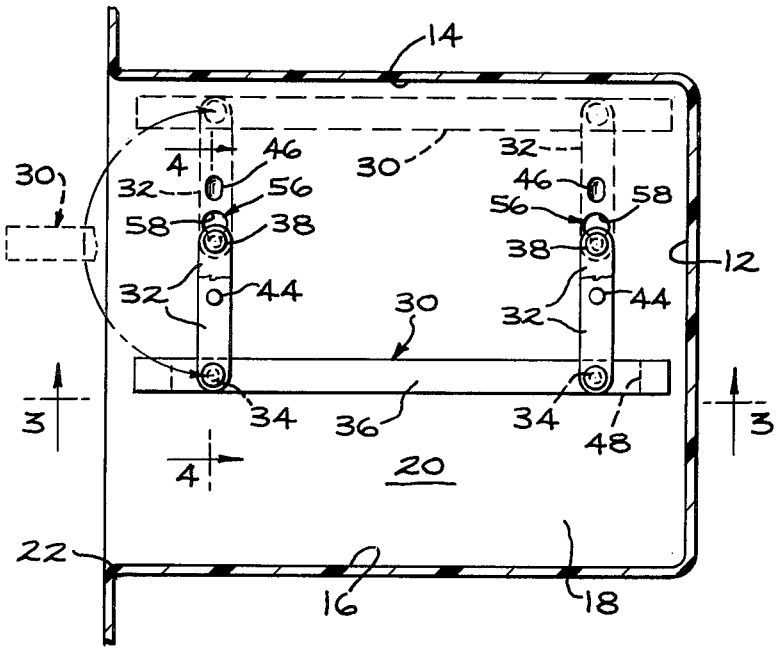
FIG. 2 is a side elevational view of a microwave oven showing the rack of the present invention in its cooking position.

In accordance with the present invention, a self-storing meal rack is provided which may be pivoted between a cooking or storing position. The rack 30 is smaller than the cavity, leaving a clearance between side and rear walls 18 of cavity 20. As shown in FIG. 1, the rack 30 is supported on each side by a pair of arms 32. One end of each arm 32 is pivotally secured at 34 to the side edge portion 36 of the rack 30. The other end of each arm 32 is pivotally attached at 38 to the side walls 18 of the cavity 20. The rack 30 is rotated from the cooking position shown in FIG. 2 to the self-storing position shown by broken lines. In moving between its cooking and storing position, the pair of arms 32 on each side of the rack 30 pass through an arc of approximately 180°, as indicated by broken lines. The length of the arms 32 and the position of the pivots 38 are such that the rack 30 when raised to its self-storing position, as shown by broken lines in FIG. 2, is adjacent to and parallel with the top wall 14 of the cavity 20. In its lowered or cooking position, the rack 30 is spaced from the bottom wall 16. The rack 30 in its cooking position is spaced from the bottom wall a distance sufficient to permit meals or items to be cooked to be placed both on the bottom wall 16 and the rack 30. In the event the meal to be cooked is of a size and type that the rack would interfere with its placement in the oven, the rack would then be moved to its self-storing position.

Figure 4:
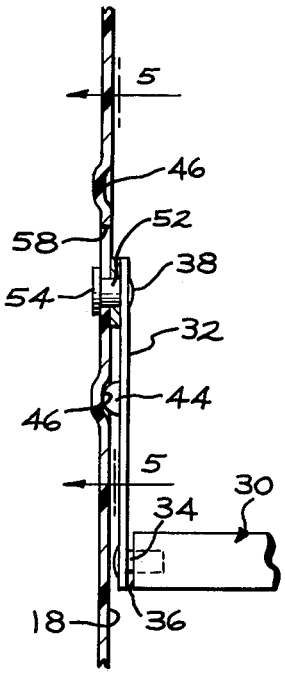
FIG. 4 is a fragmentary sectional view taken along lines 4—of FIG. 2.
Figure 3:
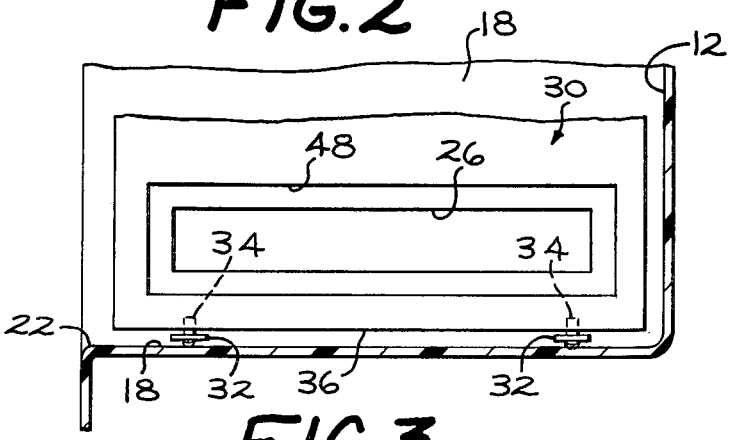
FIG. 3 is a partial plan view taken along lines 3—3 of FIG. 2.
Figure 5:
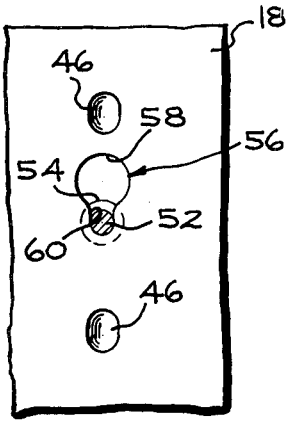
FIG. 5 is a fragmentary elevational view taken along line 5—5 of FIG. 4 showing the rack support structure.

In operation, to move the rack 30 from one position to the other, the user of the microwave oven, as shown by broken lines in FIG. 2, simply pulls or swings the rack forward through the cavity opening 22 allowing the arms 32 to pivot through approximately 180° until the rack 30 is in either of its selected positions in the cavity 20. To insure the stability of the rack when it is in either position, holding means are provided for securely maintaining the rack 30 in its selected position. In the illustrative embodiment of the present invention, the latching of the rack 30 in its selected position is accomplished, as shown in FIGS. 4 and 5, by the utilization of a latching and detent means. Projecting from each of the arms 32 is a latching tab 44. The tab 44 is located on the arms 32 so as to cooperatively engage detents 46 located on the side walls 18 of the cavity 20. The detents 46 are spaced 180° vertically above and below the pivot 38 so that arms 32 are in a substantially vertical position and the rack parallel with the upper and lower walls when the rack is in either the cooking or self-storing position. When the rack is in its lower or cook position, the tabs 44 on arms 32 engage the lower detent 46, as shown in FIG. 4, and in the stored or upper position the tabs 44 on arms 32 engage the upper detents 46. When the rack is located in its oven top or self-storage position, provision is made for clearance so that there is no change in polarization of excitation. To this end, the rack 30 is provided with a plurality of openings 48 which align with and are larger than the waveguide slots 26, as shown in FIG. 3. It should be understood that when the present rack system is used in conjunction with a microwave oven employing a rotating antenna in its excitation system, the apertures in the rack would be placed and dimensioned so as not to interfere with the radiation pattern of the antenna.

By the present invention, means are provided for permitting removal of the rack 30 from the oven cavity for cleaning of the rack or oven cavity. To this end, the pivots 38, as shown in FIG. 5, include a shaft 52 which is secured to the arms 32. Adjacent the free end of shaft 52 there is provided an enlarged portion 54. Formed on the side walls 18 are keyhole shaped apertures 56 having an upper larger portion 58 dimensioned to permit insertion of enlarged portions 54 of the shaft 52 and a lower smaller portion 60 dimensioned to accommodate the shaft 52. In positioning the rack 30 within the cavity 20, the enlarged end portions 54 of the shafts 52 are placed in the portion 58 of their respective aperture 56. The shaft 52 is then aligned with the portion 60 and lowered into its pivoting position. To remove the rack the procedure is merely reversed.

It should be apparent to those skilled in the art that the embodiment described heretofore is considered to be the presently preferred form of this invention. In accordance with the Patent Statutes, changes may be made in the disclosed apparatus and the manner in which it is used without actually departing from the true spirit and scope of this invention.

What is claimed is:

1. A microwave oven having a bottom surface, a top surface having waveguide slots, rear walls, side walls, an access opening and an oven door hingedly mounted relative to said access opening between an open and closed position, a self-storing cooking rack comprising:

a food rack within said microwave oven;

arms on each side of said rack, each pivotally secured on one end to said rack and on the other end being pivotally secured to the side walls of said microwave oven for allowing movement of said rack between a lower cooking position wherein said rack is spaced from said bottom surface a distance sufficient to provide a cooking area between said rack and said bottom surface, and an upper storage position wherein said rack is positioned adjacent said top surface;

holding means including detent means on said arms dimensioned to engage a first cooperating detent means on said microwave oven side walls for holding said rack in said lower cooking position when said arms are rotated to a position below said side wall pivot and for engaging a second cooperating detent means on said microwave oven side walls for holding said rack in said upper storage position when said arms are rotated to a position above said side wall pivot;

said rack having apertures therein to permit unobstructed propagation of microwave energy to the lower portion of said cavity when said rack is in its upper storage position.

2. The microwave oven recited in claim 1 wherein said apertures are aligned with said waveguide slots in the upper surface of said microwave oven when said rack is in its upper storage position.

3. The microwave oven recited in claim 1 wherein the detent means on said microwave oven side walls are spaced 180° vertically above and below the side wall pivot so that said arms are in a substantially vertical position and the rack parallel to said top and bottom surfaces when said rack is in either its lower cooking position or upper storage position.

* * * * *